US007744171B2

(12) United States Patent
Carter

(10) Patent No.: US 7,744,171 B2
(45) Date of Patent: Jun. 29, 2010

(54) ACCESSORY PERSONNA MOI

(76) Inventor: Ellen Lelita Thomas Carter, 5630 Vernon Rd., Jacksonville, FL (US) 32209

( * ) Notice: Subject to any disclaimer, the term of this patent is extended or adjusted under 35 U.S.C. 154(b) by 0 days.

(21) Appl. No.: 11/402,628

(22) Filed: Apr. 12, 2006

(65) Prior Publication Data

US 2007/0241649 A1 Oct. 18, 2007

(51) Int. Cl.
*A47B 53/00* (2006.01)

(52) U.S. Cl. ..... 312/198; 312/290; 312/223.5; 312/227

(58) Field of Classification Search ..... 312/290, 312/107, 198, 223.5, 224, 225–227, 283, 312/322

See application file for complete search history.

(56) References Cited

U.S. PATENT DOCUMENTS

| | | | | | |
|---|---|---|---|---|---|
| 1,412,895 | A | * | 4/1922 | Rosenthal | 312/107 |
| 1,434,220 | A | * | 10/1922 | Morris | 312/107 |
| 1,690,404 | A | * | 11/1928 | Dieckmann | 312/204 |
| D203,120 | S | * | 12/1965 | Grant | D6/438 |
| 3,563,624 | A | * | 2/1971 | Stice | 312/198 |
| 4,736,996 | A | * | 4/1988 | Zeichner | 312/198 |
| 5,626,404 | A | * | 5/1997 | Kelley et al. | 312/198 |
| 6,712,711 | B1 | * | 3/2004 | Skelton et al. | 312/107 |
| 7,261,384 | B1 | * | 8/2007 | Craft et al. | 312/235.3 |
| 2003/0146678 | A1 | * | 8/2003 | Greiner | 312/107 |
| 2003/0164663 | A1 | * | 9/2003 | Chang et al. | 312/107 |
| 2004/0000848 | A1 | * | 1/2004 | Greiner | 312/107 |

FOREIGN PATENT DOCUMENTS

| | | |
|---|---|---|
| DE | 3411348 | * 10/1985 |
| DE | 3416603 | * 11/1985 |

* cited by examiner

*Primary Examiner*—Hanh V Tran

(57) ABSTRACT

This new accessory chest is a four piece sectioned assembly storage chest that will neatly store from top to bottom and throughout the chest, a large or small amount of separated variety of accessory selections of dressing attire that will complement the clothing to be worn and to use as a storage for these accessories until ready to use. A grooming area will be available with a midsection fold down doll valet that also swivels to the other side for apparel dressing, rolls out and lock whereby a storage seat is available there to finalize the dress by putting on the footwear. Pre-dressing and having the accessory attire in one location should have conserved time and shows a 'preview of how you want to coordinate the apparel/accessories for the occasion'. The suggested variety includes, but not exclusive to: shoes, boots, socks/stockings, sneakers, purses/shoulder bags, belts, scarves/ties, house slippers, hats/caps, gloves, glasses/shades, jewelry variety and even extra hair plus more . . . The versatility and flexibility variety of this chest is probably all in a class by itself.

1 Claim, 8 Drawing Sheets

COMPLETE ASSEMBLY OF THE FOUR-SECTIONED ACCESSORY CHEST

DETAILED PERSPECTIVE VIEW OF ACCESSORY CHEST

PLAN VIEW DETAIL CENTRAL STORAGE CHEST

DRAWER DETAIL

BIN DETAIL

ACCESSORY STORAGE DETAIL

JEWELRY STORAGE FLAP DETAIL

Figure 1:
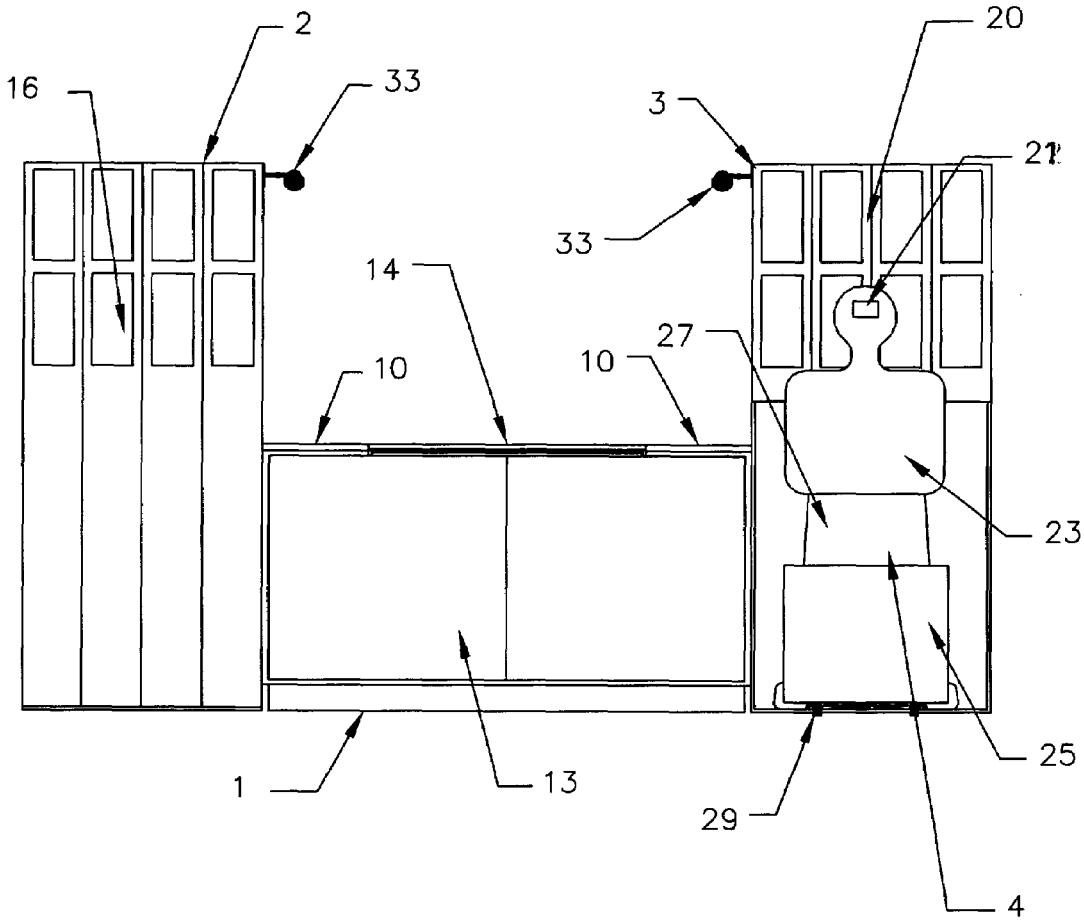

PERSPECTIVE VIEW
LEFT SHELF
ASSEMBLY DETAIL

PERSPECTIVE VIEW
BOOT TREE
DETAIL

PERSPECTIVE VIEW
BOOT HOOKS
DETAIL

LEFT SHELF UPPER
STORAGE DETAIL

LEFT SHELF LOWER
STORAGE DETAIL

LEFT SHELF DOOR DETAIL

PLAN VIEW RIGHT & LEFT SHELF DOOR DETAIL

RIGHT SHELF ASSEMBLY DETAIL

RIGHT SHELF UPPER STORAGE SHELVING AND HANGER DETAIL

HAT/CAP ETC. HOOK DETAIL

REAR/FRONT PERSPECTIVE VIEW COMPLETE DOLL DETAIL

PERSPECTIVE VIEW DETAIL DOLL MOTION & STOOL SUPPORT

FOLDED DOLL DETAIL

COMPLETE DOLL DETAIL

SEAT SUPPORT DETAIL

SEAT SUPPORT MOTION INDICATOR

LOCKING CASTERS DETAIL

PERSPECTIVE VIEW
LIGHT ASSEMBLY DETAIL

ACCESSORY PERSONNA MOI

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

1. Technical Field

This invention relates to an accessory chest that stores and make readily available the attire and finishing attire for dress while having an area for grooming the hair or choice usages, with a roll out doll to pre-dress that should conserve time for any occasion of dress. The design will benefit teens and adults, male or female. Choice items of accessory wear selected may be stored with ease of separate selections until each item is ready to be worn. An armoire or clothes closet is to clothes as this accessory chest is to jewelry variety, eyeglasses/shades, gloves, handbags, toiletries, etc. and more, even extra hair that has a doll valet to fit it on, plus, pre-dress the attire and all other accessorizing items that finishes the dress attire in a one chest location. It should tidy a room, it should make for a spacious area and keep one from searching to find accessorizing items which should conserve time, and be conveniently beneficial. The chest will be for the residential and commercial customer.

2. Brief Description of Prior Art

There are other chest that accessorizes certain items, this chest accessorizes items in a neat all-in-one chest with a vastly large selection variety of items that accessorizes to complement your dress-up needs from jewelry to sneakers or whatever completes the accessory dress and stores the items until use. From top to bottom and throughout the chest, that will include having a grooming area, compartments, dividers, bins, hooks, tree hangs, shoe drawers, shelves, pockets, mirrors, etc. and a doll valet that swivels to make both sides available to completely pre-dress most, if not all, of your dressing needs, even including that extra hair. Its design will also feature ease of movement. This accessory chest will hold its own variety of your choice and will be suitable in sizes for your space accommodation and be conveniently a cinch. This attractive accessory chest will be with such versatility that you may convert it to suit your items of choice and with such flexibility that you will be able to place it in any location of your choice. To my knowledge there is no other accessory chest of this size or selection type caliber.

BRIEF SUMMARY OF THE INVENTION

The concept of this invention is designed with teens and adults, male or female, in mind for dressing apparel with all, or most all, of accessories right at reach my conveniently storing the finishing attire in one location while keeping the location tidy, plus, seeing an attractively designed furniture chest that is versatile and flexible to move to your choice spot in the house or studio.

Accessories maybe stored from top to bottom and throughout the four sectioned areas in its shelves, transparent shoe dividers/bins, hooks/hangers, shelf cubbies, tree like boot hangs, seat storage, pockets makeup/toiletries, lights, mirrors, and individually divided jewelry flap with pockets and holders for jewelry varieties, eyeglasses/shades, ties/scarves, slippers caddies, socks/stockings, belts, handbags, gloves, and much more . . . plus a doll valet that swivels, rolls out to pre-dress, and allows extra hair to be put on to groom, storage seat to put on footwear, folds down at the midsection and rolls back into its space to be a convenient seat. It will be constructively designed to be suitable in sizes for the residential and commercial customers.

The accessory chest should cause dressing to be fun and a cinch to conserve time for the occasion when you pre-dress overnight, several hours before the occasion, or your choice time. It should achieve comfort and ease that all items were conveniently selected from one location and to preview that "fashionable you".

A BRIEF DESCRIPTION OF DRAWINGS

FIG. 1. a. Front elevation complete assembly of the four sectioned accessory chest, b. the central storage assembly, c. the upper left shelf assembly storage, d. the upper right shelf assembly storage, e. the lower right shelf doll assembly that holds apparels for dress (both sides) with a storage seat, that side.

Figure 2:
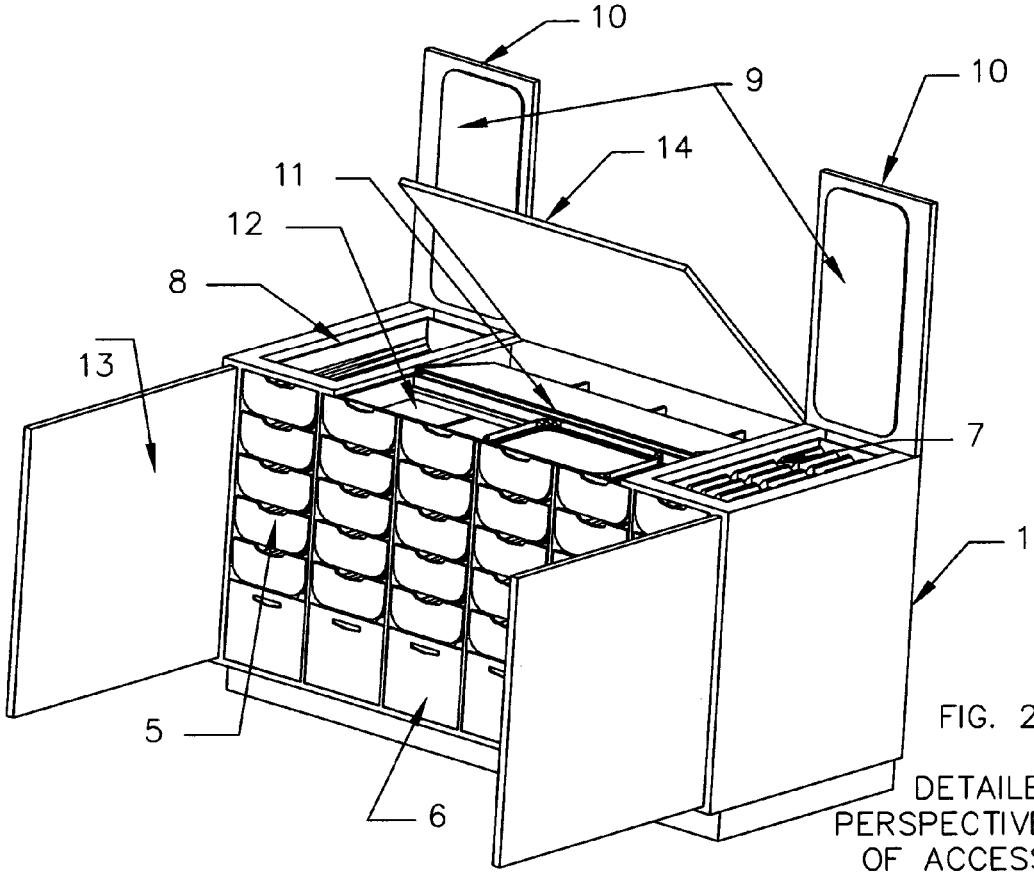

FIG. 2. a. Detail perspective view of accessory chest, b. the entire central storage, c. the transparent drawer area for shoe storage, d. the bin area for sneaker storage, e. eyeglass/shade storage under right mirror lid storage, f. misc. storage under left mirrored chest lid, g. four selective jewelry flaps for earrings, necklaces, charms, etc. of choice shared by a sliding storage tray where beneath is a storage area for watches, rings, dress pins and bracelets, h. outer chest doors that covers the central storages area.

Figure 3:
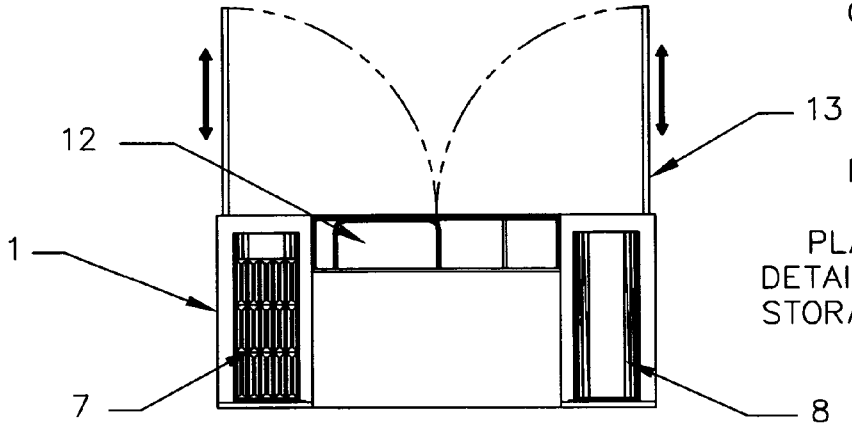

FIG. 3. a. Plan view detail central storage chest, b. shows plan view right storage, c. shows the left storage area 8 misc. drawer. d. shows utility tray that slides to/fro of the chest in that area. e. shows plan view of chest doors that opens and slides to back of chest to remain open.

Figure 4:
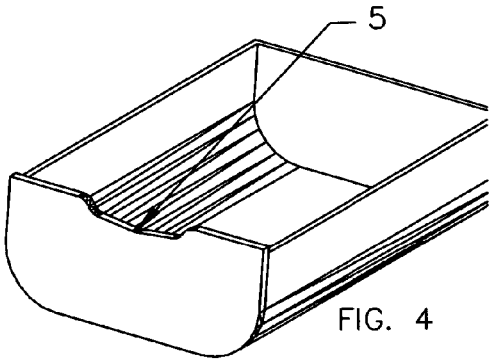

FIG. 4. Drawer detail with compartment divider to be a two (2) storage area for shoes.

Figure 5:
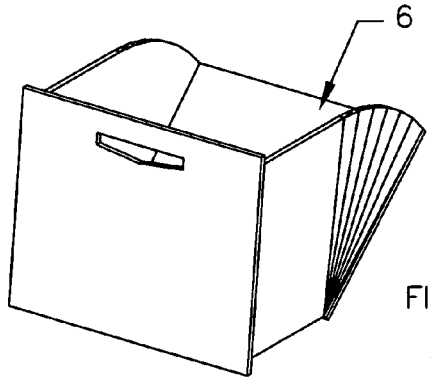

FIG. 5. Bin detail with tilt open for sneakers.

Figure 6:
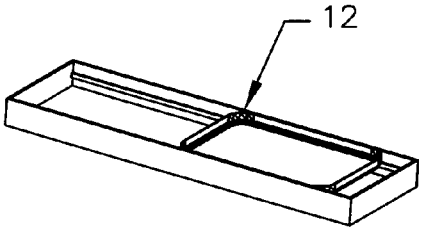

FIG. 6. Accessory storage detail of sliding tray with three (3) area primary compartments.

Figure 7:
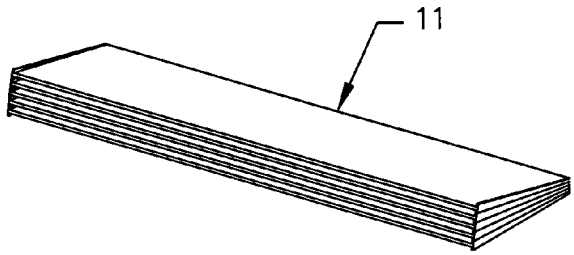
Figure 7:
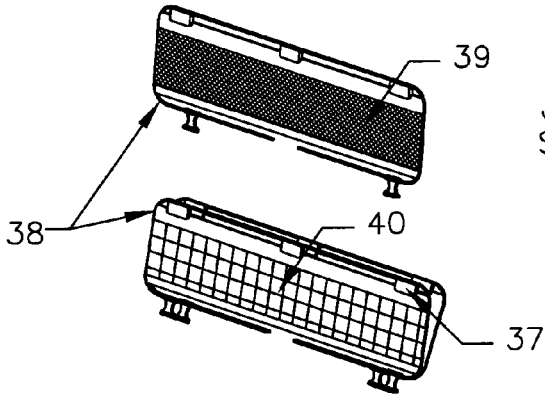

FIG. 7. a. Jewelry storage flap closed, b. jewelry storage detail open flap with necklace guard showing another with pockets for earrings.

Figure 8:
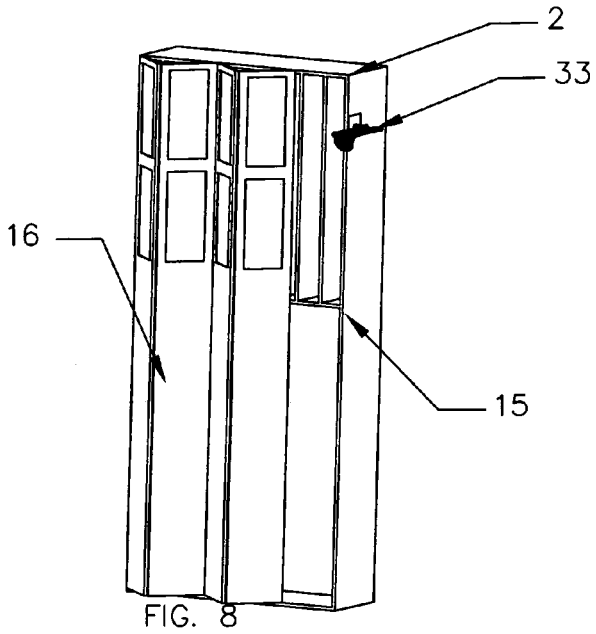

FIG. 8. a. Perspective view left shelf storage assembly detail, b. left shelf storage assembly detail, c. left shelf portion of the full bi-fold covering door, d. left side storage assembly with arm for adjustable light attachment on side of shelf.

Figure 9:
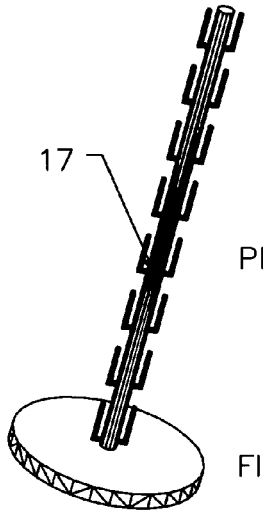
Figure 9A:
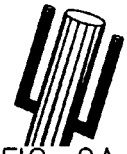

FIG. 9. a. Perspective view boot tree storage detail with anchor to shelf. 9A. b. Perspective view boot hooks detail.

Figure 10:
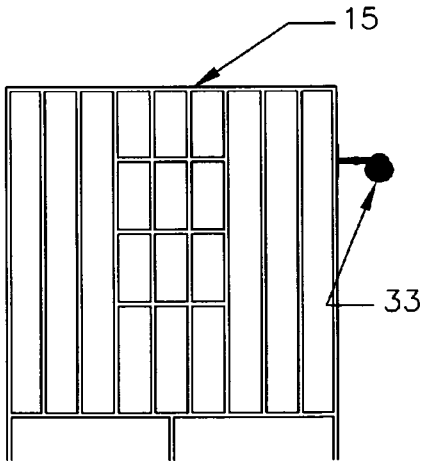

FIG. 10. a. Left shelf upper storage details shelving division, b. left side storage assembly arm for adjustable light attachment on side of shelf.

Figure 11:
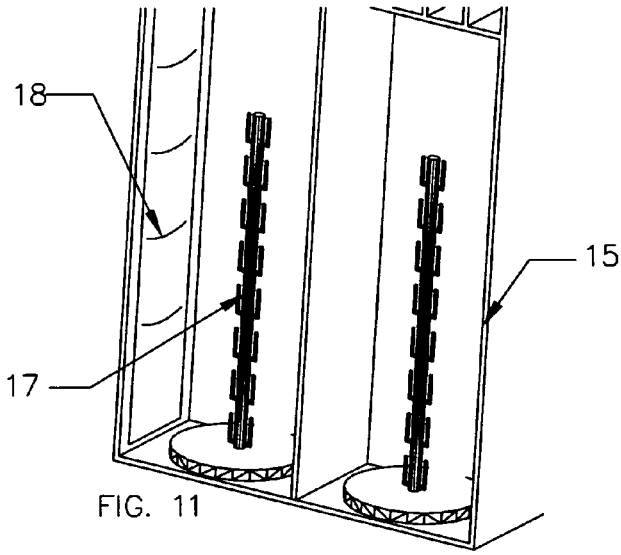

FIG. 11. Left shelf lower slipper caddy detail, b. left shelf lower two boot tree storage (left and right sides), e. slipper caddy storage(both left and right sides).

Figure 12:
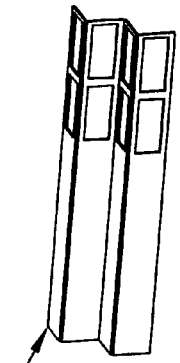

FIG. 12. Left shelf bi-fold full door detail covering.

Figure 13:
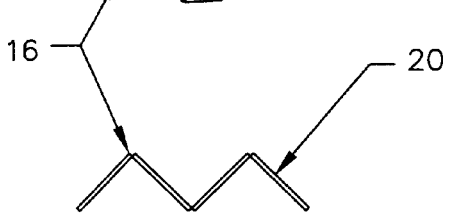

FIG. 13. a. Plan view left shelf bi-fold full door detail, b. plan view right shelf half bi-fold door detail.

Figure 14:
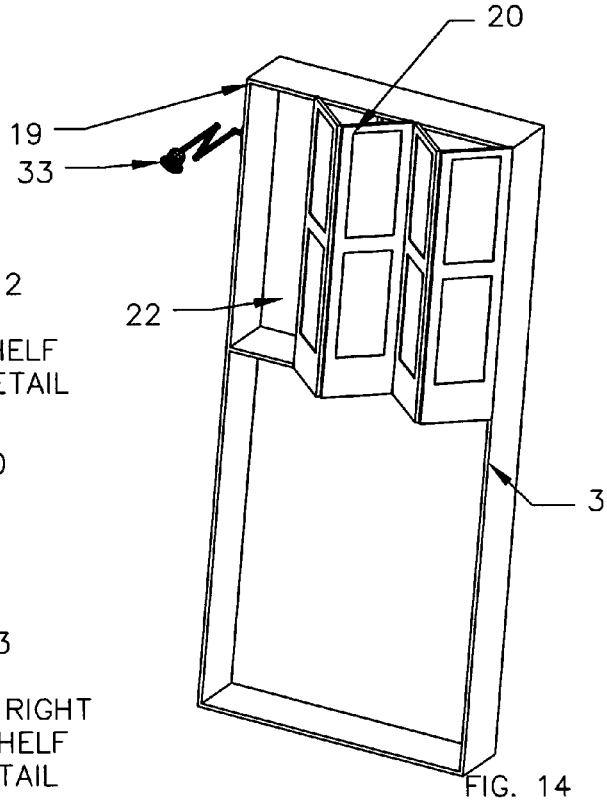

FIG. 14. a. Right shelf assembly detail, b. right shelf assembly, c. shelf portion of right shelf assembly, d. right shelf half upper bi-fold door assembly.

Figure 15:
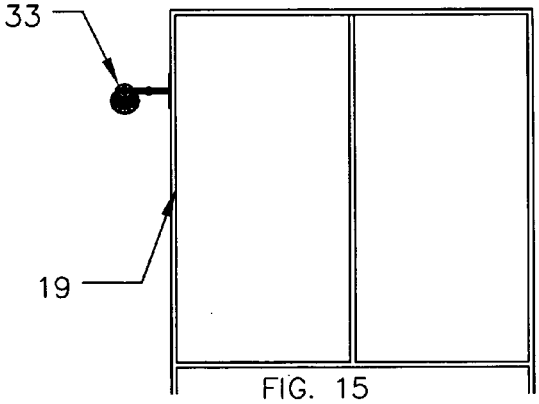

FIG. 15. a. Right shelf upper storage shelving and hanging detail.

Figure 16:
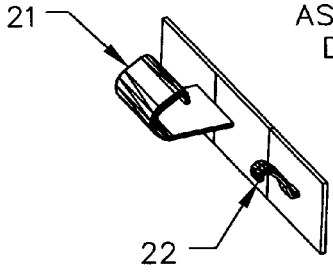

FIG. 16. Large and small hook details for hat/cap hanging and usage throughout the accessory chest.

Figure 17:
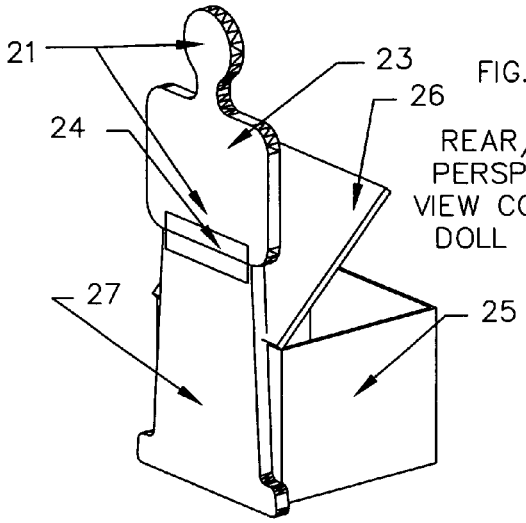

FIG. 17. a. Front/Rear view complete doll detail, b. larger hook used on doll in right shelf assembly for apparel, c. top half of hinged doll assembly for folding, d. midsection hinge that holds doll together for up/down fold, e. chest storage seat of doll assembly, f. lower half of doll assembly.

Figure 18:
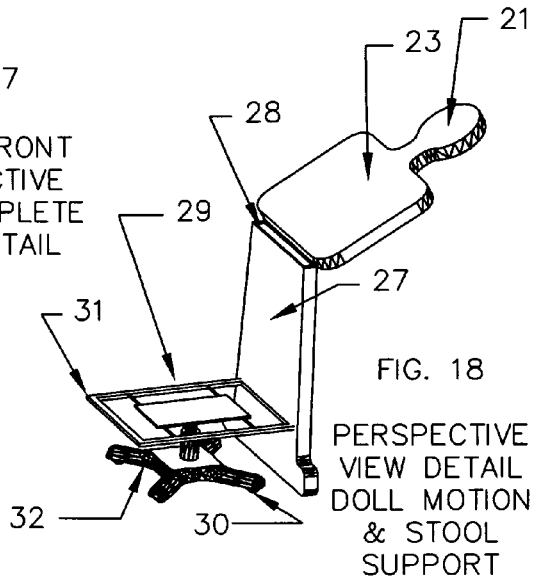

FIG. 18 a. Perspective view doll motion and seat support, b. large hook for hanging upper apparel, c. upper half of doll for dressing, d. bottom half of doll dress, e. hinge fastener area, f. support assembly for seat on doll, g. locking/unlocking caster wheels on doll seat assembly, h. base structure for support assembly that holds caster, aids swivel movement of the doll to dress apparel (both sides).

Figure 19:
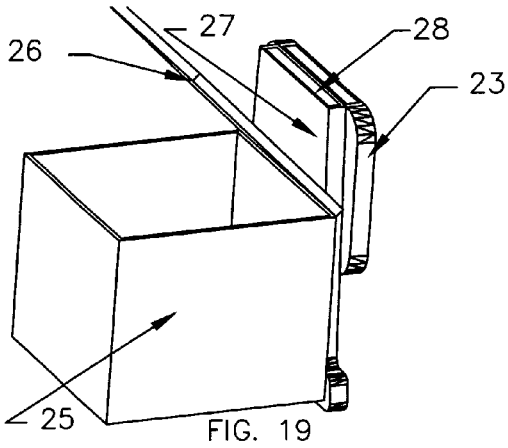

FIG. 19. a. Folded doll detail, b. folded upper half of doll assembly, c. storage seat of doll assembly, d. open lid of seat, e. lower half of doll assembly, f. fastener to hold doll assembly in upright position.

Figure 20:
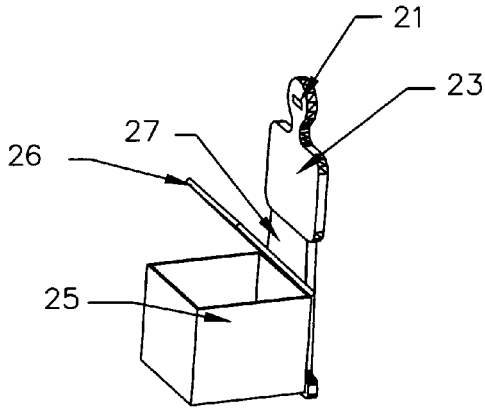

FIG. 20. a. Complete doll detail one side, b. large hook for hanging, c. top half of doll upright, d. lower half of doll, e. storage seat lid, f. storage seat assembly.

Figure 21:
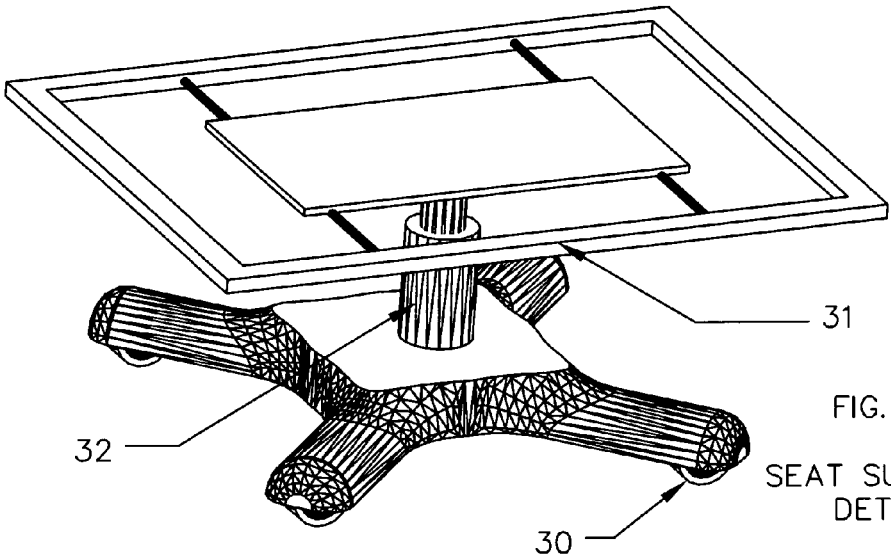

FIG. 21. a. Seat support detail, b. support structure for support assembly, c. base structure for support assembly, d. locking/unlocking wheels on doll seat assembly.

Figure 22:
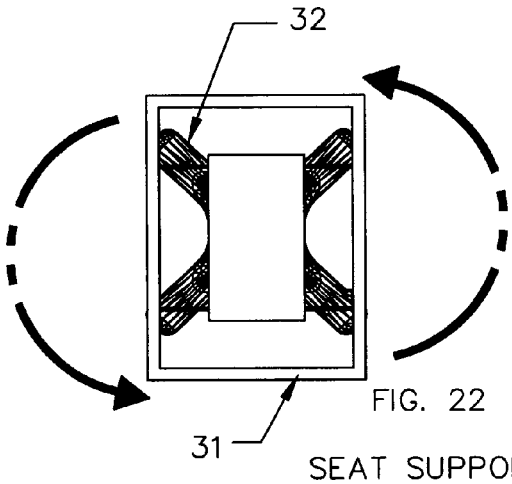

FIG. 22. a. Seat support motion indicator, b. base structure for support assembly to seat.

Figure 23:
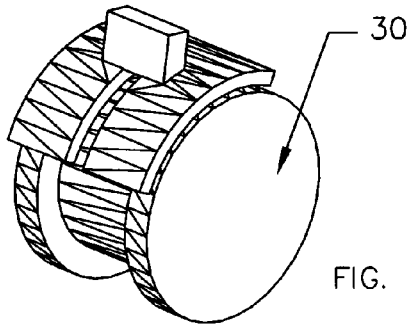

FIG. 23. Locking caster detail.

Figure 24:
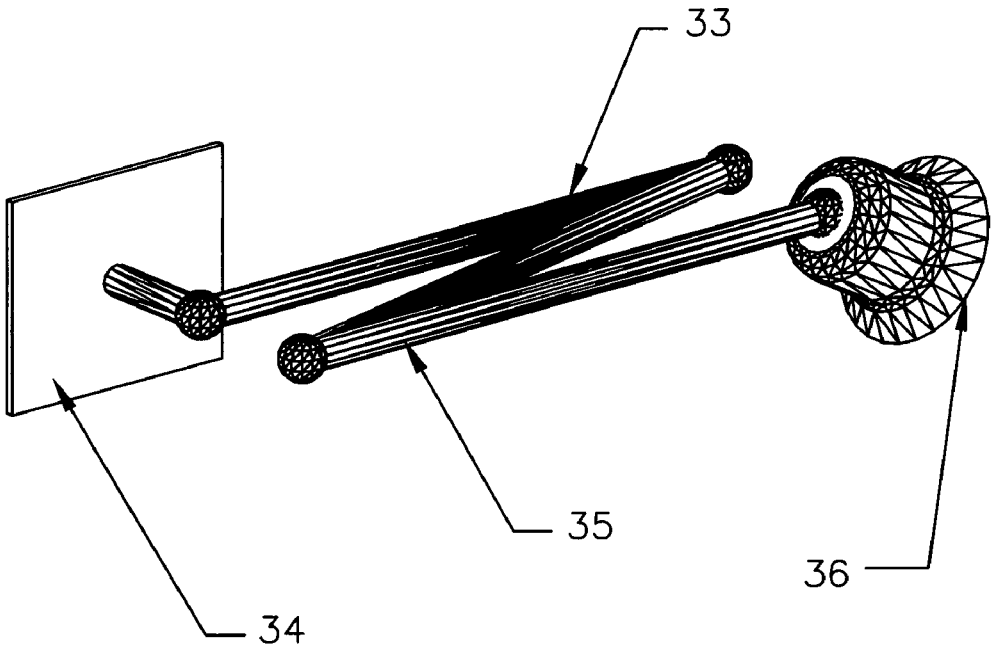

FIG. 24. a. Light assembly detail perspective view, b. light attachment assembly, c. base attachment piece, d. extension arm, e. light holder.

DETAILED DESCRIPTION OF THE DRAWINGS

FIG. 1) a. Refers to the front elevation of the complete four set assembly storage accessory chest 0. b. the central outer chest doors 13 with left side 10 closed lid, right side 10 closed lid and closed top lid covering 14. c. the left shelf assembly 2 shows the closed outer door 16 and the attached left shelf light 33. d. the right shelf assembly 3 shows the closed upper half outer door 20, and the attached right shelf light 33. e. the lower half of the right shelf assembly 3 shows the doll assembly 4 starting mid face, a hook 21 that holds a hanger for apparel, while the top half of hinged doll assembly 23, with the storage seat 25, the lower half of the hinged doll assembly 27 and the support assembly for the storage seat 29.

FIG. 2) a. Shows a detail perspective view of the central accessory chest storage with transparent drawer holders at the bottom of the storage 5 above the tilt open bins 6 that holds the sneakers and the pull out-slide back outer door 13. b. the upper right side storage 7 holds eyeglasses/shades under the mirrored 9 and lid 10 c. the left side a misc. storage drawer 8 under the mirrored 9 and lid 10 of the chest, d. the center of the central accessory chest 1 stores in the rear of chest area, a five part closed jewelry flap 38 with individual flaps of secured covers 39 with fasteners 37 and pocketed flaps 40 for earrings detailed in FIG. 7/page 3, of these drawings, while at front center area is a utility tray 12A that slides to/fro above that same storage area 12 that holds watches, rings, dress pins, bracelets and charms with the top lid 14 being the center closure for the chest.

FIG. 3) a. Shows the plan view detail of central storage chest 1. b. shows plan view right storage 7 where the eyeglass/shades are stored c. shows the left storage area 8 misc. drawer. d. shows the utility tray 12A that slides to/fro above that storage area. e. shows plan view of chest doors 13 that opens and slides to back of chest to remain open and closes to cover storage.

FIG. 4) Drawer detail shows divided compartment upper mid portion 5 that may storage two pairs of shoes which is located in the central storage chest 1.

FIG. 5) Bin detail shows tilt open for sneakers to be stored at lower mid portion 6 in the central storage chest 1.

FIG. 6) Accessory storage detail of the utility tray 1 2A that slides to/fro each side above the storage area 12 that holds watches, rings, bracelets, etc. in the upper storage primary area compartments.

FIG. 7) a. Jewelry flap storage detail shows the jewelry holder flap 11 closed. b. shows two of five flaps 38 removed to show each of their individual movement where one flap shows the Velcro pads 37 for open/close while two of the individual flaps 38 refers to a covering guard 39 for necklaces and another flap 40 showing pockets to hold earrings or choice other items.

FIG. 8) a. Perspective view left shelf assembly detail refers to left shelf 2 with a full bi-fold door 16 that covers the outside of the shelf while the left shelf assembly 15 shows a complete upper and lower portion with the attached light assembly 33 hangs at the upper area.

FIG. 9) a. Perspective view boot tree and 9A boot hooks detail shows boot tree holder 17 for boots b. boot hooks 9A shows location for applying boots.

FIG. 10) a. Left shelf upper storage detail shows a complete upper left assembly with shelf showing vertical and horizontal storage 15 to hold belts, scarves, handbags, ties, gloves, ribbons, etc. or your choice items. b. the light assembly attachment 33 is attached to the side—see FIG. 16 for hooks.

FIG. 11) a. Left shelf lower storage detail shows the complete assembly 15. b. the boot trees 17 positioned in perspective and slipper caddy 18 for soft shoes or misc. items of choice area.

FIG. 12) Left shelf door detail shows full bi-fold 16 for shelf closure of entire items in that storage area.

FIG. 13) a. Plan view detail of left shelf bi-fold door 16. b. with right shelf bi-fold door 20 that shows half bi-fold upper door assembly storage 3.

FIG. 14) a. Right shelf assembly detail view shows right shelf storage 3. b. shows upper half bi-fold door assembly 20 that covers the upper shelf 22. c shows a portion of the upper shelf storage 19. d. shown here is the light assembly attachment 33.

FIG. 15) Right upper shelf view shows storage area upper shelf detail 19 that will be hanging area for hats/caps or other choice items.

FIG. 16) Views details of large hook 21 and small hook 22 that will be used in hanging areas throughout the entire accessory chest where necessary.

FIG. 17) a. Perspective view complete doll valet detail, front/rear 4. b. shows front view head area large hook 21 for placing hanger to hand blouse/shirt securely. c. shows the upper half 23 of the doll valet. d. shows the midsection hinge 24 to fold the doll valet. e. shows the lower half 27 just above the mid-section hinge that holds apparel. f. shows the fastener 28 that supports the open/close mid-section with the rear view showing the storage seat 25 open lid of storage seat 26.

FIG. 18) a. Perspective view detail doll motion and seat support 32. b. shows the head hook area 21 for the upper half apparel 23. c. shows where apparel hang 23 just below hinge 24 with the showing area of the fastener 28 to open/close at mid-section positions. The lower section 27 just above the support assembly 27 for storage assembly seat 29 where the locking/unlocking caster wheels 30 for doll valet motion and the support structure for support assembly 31 which is connected to the seat and storage 25 (not seen here) while the seat assembly at the base structure support 32 holds locking casters 30 and aids in the swivel movement of seat and doll assembly.

FIG. 19) a. Folded doll detail at the midsection 24. b. shows upper half 23 of doll assembly. c. shows storage seat 25 of doll assembly. d. shows open lid 26 of the seat. e. shows lower half 27of doll assembly. f. shows fastener 28 to hold doll in upright position.

FIG. 20) a. Complete doll detail rear side. b. shows the large hook 21 to place apparel. c. shows top half of doll 23 that will hold apparel. d. shows lower half of doll 27 which will act as back rest once doll is in fold down position. e. shows the storage seat lid 26. f. shows the storage seat assembly 25.

FIG. 21) a. Seat support detail 29. b. support structure for support assembly 31 to weight seat and floor of storage bin in doll assembly. c. shows base structure 32 for support assembly that holds casters and aids in the swivel movement of seat and doll assembly. d. shows locking/unlocking wheels 30 on doll seat assembly.

FIG. 22) a. Storage seat support motion indicator 32 holds the casters and aids in swivel while support structure 31 is viewed that support the weight for seat and bin floor.

FIG. 23) Locking casters detail shows the wheels on the storage seat of doll assembly 30.

FIG. 24) Perspective view detail light assembly shows the arm attachment assembly 33 for lighting on left shelf assembly 2 left side and right shelf assembly 3 right side are attached while base attachment piece 34 that allows light assembly to be adjustable for various positions of optimum lighting capability with extension arm 35 allowing the various positions to have the light holder 36 support battery powered light fixture support.

I claim as my invention:

1. A storage chest assembly comprising:

a first side section having left and right side walls, a top wall, a bottom wall and a back wall, the walls defined an interior storage space, a bi-fold door hingedly connected thereto, a plurality of shelves within the interior space providing horizontal and vertical storage compartments, at least one boot tree provided therein for storing boots;

a second side section having left and right side walls, a top wall, a bottom wall and a back wall, the walls defined an interior storage space, a horizontal shelf secured therein to provide upper and lower storage compartments, a half bi-fold door hingedly connected thereto to cover only the upper storage compartment;

a center section having left and right side wall, a bottom wall and a back wall, the walls defined an interior storage space, two front doors hingedly connected to the center section, a plurality of shelves within the interior space providing storage compartments, a plurality of drawers and storage bins provided within said storage compartments, wherein each drawer and bin includes a cutout portion as a handle, upper left and right side storage compartments each having a lid, and a mirror attached to an inner surface of said lid, an upper center storage compartment having a plurality of jewelry flaps and a slidable utility tray provided therein, an upper center lid covering the upper center storage compartment;

a seat having a storage compartment and a pivot top, a back rest including a lower portion connected to the storage compartment and an upper portion hinged connected to the lower portion, casters provided to the bottom of the seat; wherein in a storage configuration, the seat is stored in the lower storage compartment of the second side section;

wherein a first light is affixed to the exterior surface of the right side wall of the first side section, a second light is affixed to the exterior surface of the left side wall such that the lights illuminate the center section, and a plurality of hooks provided within at least one of the first and second side sections for hanging accessory.

* * * * *